US005429211A

United States Patent [19]

Aulanko et al.

[11] Patent Number: 5,429,211

[45] Date of Patent: Jul. 4, 1995

[54] TRACTION SHEAVE ELEVATOR

[75] Inventors: Esko Aulanko, Kerava; Jorma Mustalahti; Harri Hakala, both of Hyvinkää, all of Finland

[73] Assignee: Kone Oy, Helsinki, Finland

[21] Appl. No.: 264,343

[22] Filed: Jun. 23, 1994

[30] Foreign Application Priority Data

Jun. 28, 1993 [FI] Finland ..... 932977
Apr. 14, 1994 [FI] Finland ..... 941719

[51] Int. Cl.[6] ..... B66B 11/08
[52] U.S. Cl. ..... 187/254; 187/406
[58] Field of Search ..... 187/17, 20, 94, 95, 187/254, 404, 406

[56] References Cited

U.S. PATENT DOCUMENTS

| | | | |
|---|---|---|---|
| 12,640 | 4/1855 | Murtaugh | 187/17 |
| 4,977,980 | 12/1980 | Hifumi | 187/20 X |
| 5,018,603 | 5/1991 | Ito | 187/20 X |
| 5,025,893 | 6/1991 | Saito | 187/20 |
| 5,036,954 | 8/1991 | Haahtikivi et al. | 187/20 X |

FOREIGN PATENT DOCUMENTS

| | | | |
|---|---|---|---|
| 2640604 | 12/1988 | France | 187/20 X |
| 1032496 | 6/1958 | Germany . | |
| 1242386 | 9/1989 | Japan | 187/17 X |
| 436619 | 11/1967 | Switzerland . | |
| 2138397 | 10/1984 | United Kingdom | 187/20 X |
| 1216119 | 3/1986 | U.S.S.R. | 187/20 X |
| 1266829 | 10/1986 | U.S.S.R. | 187/20 X |
| 1751134 | 7/1992 | U.S.S.R. | 187/20 X |

*Primary Examiner*—David H. Bollinger
*Assistant Examiner*—Dean A. Reichard

[57] ABSTRACT

The traction sheave elevator comprises an elevator car (1) moving along elevator guide rails (10), a counterweight (2) moving along counterweight guide rails (11), a set of hoisting ropes (3) on which the elevator car and the counterweight are suspended, and a drive machine unit (6) comprising a traction sheave (7) driven by the drive machine and engaging the hoisting ropes (3). The drive machine unit (6) of the elevator is placed in the top part of the elevator shaft (15) in the space between the shaft space needed by the elevator car on its path and/or its overhead extension and a wall of the elevator shaft (15).

19 Claims, 7 Drawing Sheets

TRACTION SHEAVE ELEVATOR

FIELD OF THE INVENTION

The present invention relates to a traction sheave elevator.

DESCRIPTION OF THE PRIOR ART

One of the objectives in elevator development work has been an efficient and economic utilization of building space. In conventional traction-sheave driven elevators, the elevator machine room or other space reserved for the drive machinery takes up a considerable portion of the building space needed for the elevator. The problem is not only the volume of the building space needed for the drive machinery, but also its location in the building. There are numerous solutions to the placement of the machine room, but they generally significantly restrict the design of the building at least in respect of space utilization or appearance. For example, a machine room placed on the roof of a building can be felt to be a flaw of appearance. Being a special space, the machine room generally involves increased building costs.

In prior art, hydraulic elevators are relatively advantageous with respect to utilization of space, and they often allow the entire drive machine to be placed in the elevator shaft. However, hydraulic elevators are only applicable in cases where the lifting height is one floor or at most a few floors. In practice, hydraulic elevators cannot be constructed for very large heights.

SUMMARY OF THE INVENTION

To meet the need to achieve a reliable elevator which is advantageous in respect of economy and space utilization and for which the space requirement in the building, irrespective of the hoisting height, is substantially limited to the space required by the elevator car and counterweight on their paths including the safety distances and the space needed for the hoisting ropes, and in which the above-mentioned drawbacks can be avoided, a new type of traction sheave elevator is presented as an invention. The traction sheave elevator of the invention is characterized by the drive shaft of the elevator being placed in the top part of the elevator shaft in the space between the shaft space needed by the elevator car on its path and/or its overhead extension and a wall of the elevator shaft.

The advantages which can be achieved by applying the present invention include the following:

- The traction sheave elevator of the invention allows an obvious space saving to be achieved in the building because no separate machine room is needed.
- Efficient utilization of the cross-sectional area of the elevator shaft.
- Advantages in manufacture and installation because the system has fewer discrete components than conventional traction sheave elevators.
- In elevators implemented using the invention, the ropes meet the traction sheave and diverting pulleys from a direction aligned with the rope grooves of the diverting pulleys, a circumstance which reduces rope wear.
- In elevators implemented using the invention, it is not difficult to achieve a centric suspension of the elevator car and counterweight and therefore a substantial reduction of the supporting forces applied to the guide rails. This permits the use of lighter guide rails as well as lighter elevator and counterweight guides.
- The design of the elevator allows the elevator to be implemented using other than rucksack-type suspension, permitting the area of application of the elevator solution to be more easily expanded to cover large loads and high speeds.
- The elevator car and safety gear frame can be designed without problems using the solutions applied in conventional elevators with a machine room, which are lighter and simpler than those used in rucksack-type elevators.
- In elevators implemented according to the invention, the supporting forces applied to the guide rails are of a moderate order.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described in detail by the aid of some of its embodiments by referring to the attached drawings which are given by way of illustration only, and thus are not limitative of the present invention, and in which.

DESCRIPTION OF THE PREFERRED EMBODIMENTS

Figure 1:
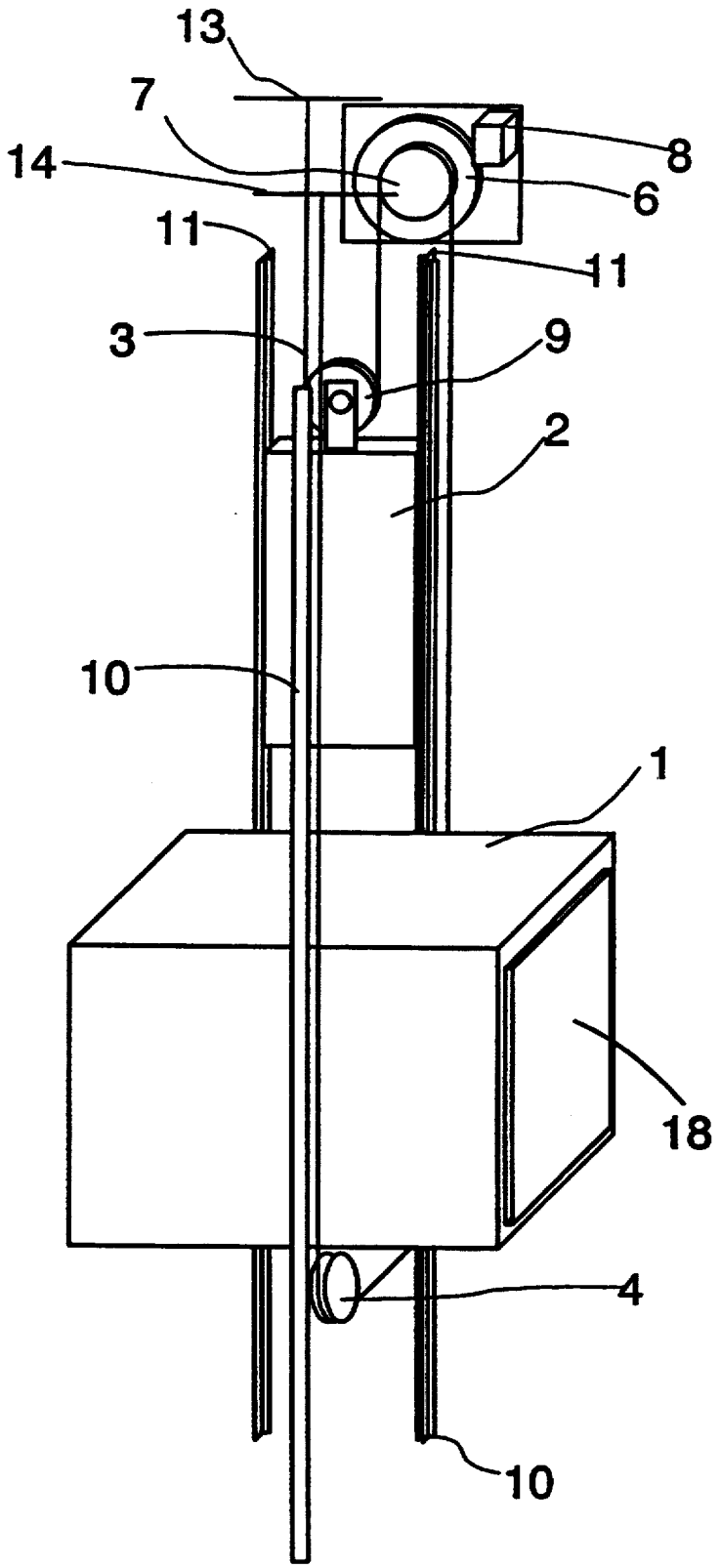
FIG. 1 presents a traction sheave elevator according to the invention in diagrammatic form.

A traction sheave elevator according to the invention is presented in FIG. 1 in diagrammatic form. The elevator car 1 and counterweight 2 are suspended on the hoisting ropes 3 of the elevator. The hoisting ropes 3 preferably support the elevator car 1 substantially centrically or symmetrically with respect to the vertical line passing via the center of gravity of the elevator car 1. Similarly, the suspension of the counterweight 2 is preferably substantially centric or symmetrical relative to the vertical line going through the center of gravity of the counterweight. In FIG. 1, the elevator car 1 is supported by the hoisting ropes 3 by means of diverting pulleys 4,5 provided with rope grooves, and the counterweight 2 is supported by a grooved diverting pulley 9. The diverting pulleys 4 and 5 preferably rotate substantially in the same plane. The hoisting ropes 3 usually consist of several ropes placed side by side, usually at least three ropes. The drive machine unit 6 of the elevator with a traction sheave 7 engaging the hoisting ropes 3 is placed in the top part of the elevator shaft.

The elevator car 1 and the counterweight 2 travel in the elevator shaft along elevator and counterweight guide rails 10,11 which guide them. The elevator and counterweight guides are not shown in the figure.

In FIG. 1, the hoisting ropes 3 run as follows: One end of the hoisting ropes is fixed to an anchorage 13 above the path of the counterweight 2 at the top part of the shaft. From the anchorage 13, the ropes go downwards until they meet a diverting pulley 9, which is rotatably mounted on the counterweight 2. Having passed around the diverting pulley 9, the ropes 3 go again upwards to the traction sheave 7 of the drive machine 6, passing over it along rope grooves. From the traction sheave 7 the ropes go downwards to the elevator car 1, passing under it via the diverting pulleys 4,5 supporting the elevator car 1 on the ropes and continuing upwards to an anchorage 14 in the top part of the shaft, where the other end of the ropes is fixed. The positions of the rope anchorage point 13 in the top part of the shaft, the traction sheave 7 and the diverting pulley 9 supporting the counterweight on the ropes are preferably so aligned with respect to each other that the rope section between the anchorage point 13 and the counterweight 2 as well as the rope section between the counterweight 2 and the traction sheave 7 run substantially in the direction of the path of the counterweight 2. Another advantageous solution is one in which the anchorage 14 in the top part of the shaft, the traction sheave 7 and the diverting pulleys 4,5 supporting the elevator car are so positioned with respect to each other that the rope section going from anchorage 14 to the elevator car 1 and the rope section going from the elevator car 1 to the traction sheave 7 both run in a direction essentially parallel to the path of the elevator car 1. In this case no extra diverting pulleys are needed to direct the passage of the ropes in the shaft. The effect of the rope suspension on the elevator car 1 is substantially centric if the rope pulleys 4,5 are placed essentially symmetrically with respect to the vertical line passing through the center of gravity of the elevator car 1.

The machine unit 6 placed above the path of the counterweight 2 is of a flat construction as compared to its width, including the equipment that may be needed for the supply of power to the motor driving the traction sheave 7 as well as the necessary elevator control equipment, both of said equipments 8 being adjoined to the machine unit 6, possibly integrated with it. All essential parts of the machine unit 6 and the associated equipments 8 are placed between the shaft space needed by the elevator car and/or its overhead extension and a wall of the shaft.

Figure 2:
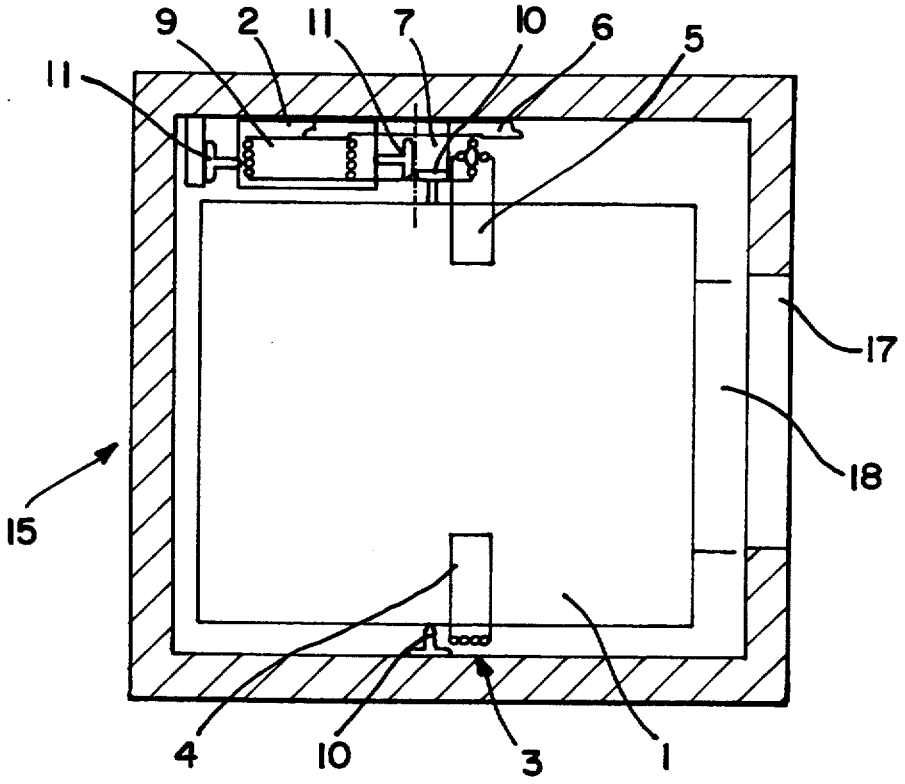
FIG. 2 presents a diagram illustrating the placement of an elevator according to the invention in an elevator shaft in top view.

FIG. 2 presents a diagram illustrating the placement of an elevator according to the invention in an elevator shaft 15. The machine unit 6 and possibly also the control panel 8 containing the equipment required for power supply to the motor and for elevator control are fixed to the wall or ceiling of the elevator shaft. The machine unit 6 and the control panel 8 can be mounted at the factory in a single integrated unit which is then installed in the elevator shaft. The elevator shaft 15 is provided with a landing door 17 for each floor, and the elevator car 1 has a car door 18 on the side facing the landing doors. Since the hoisting ropes 3 are passed below the elevator car 1, the machine unit 6 can be placed below the level which the top of the elevator car 1 reaches at the high extremity of its path. In an elevator implemented according to the solution presented, ordinary service operations on the machinery 6 and control panel 8 can be performed while standing on the top of the elevator car 1. FIG. 2 shows in top view how the machine unit 6, traction sheave 7, elevator car 1, counterweight 2 and the guide rails 10 and 11 for the car and counterweight are laid out in the cross-section of the elevator shaft 15. The figure also shows the diverting pulleys 4,5,9 used to suspend the elevator car 1 and counterweight 2 on the hoisting ropes. The hoisting ropes 3 are represented by their cross-sections in the grooves of the rope pulleys 4,5,9 and traction sheave 7.

A preferable drive machinery consists of a gearless machine with an electromotor whose rotor and stator are so mounted that one is immovable with respect to the traction sheave 7 and the other with respect to the frame of the drive machine unit 6.

Figure 3:
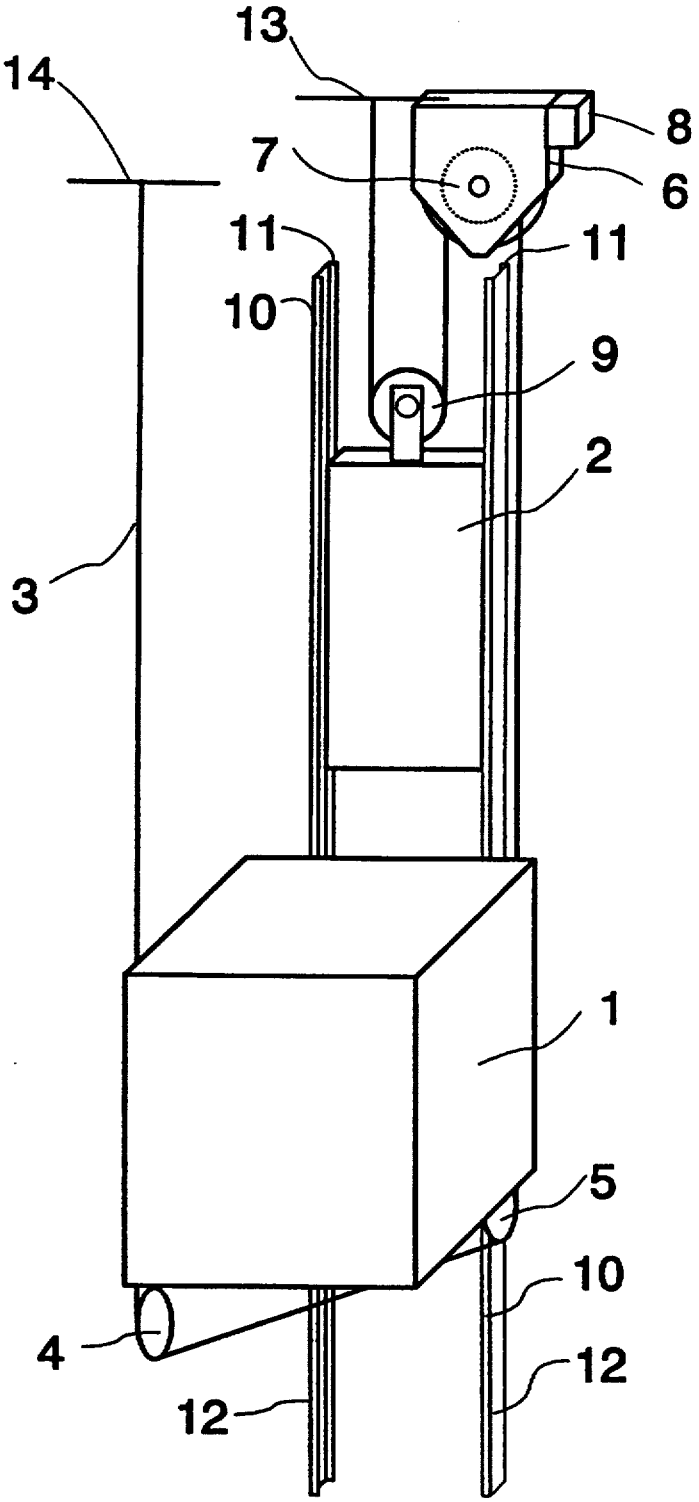
FIG. 3 presents another traction sheave elevator according to the invention in diagrammatic form.

Another traction sheave elevator according to the invention is presented in FIG. 3 in diagrammatic form. The elevator car 1 and counterweight 2 are suspended on the hoisting ropes 3 of the elevator. The hoisting ropes 3 preferably support the elevator car 1 substantially centrically or symmetrically relative to the vertical line passing via the center of gravity of the elevator car 1. Similarly, the suspension of the counterweight 2 is preferably substantially centric or symmetrical relative to the vertical line going through the center of gravity of the counterweight. In FIG. 3, the elevator car 1 is supported by the hoisting ropes 3 by means of diverting pulleys 4,5 provided with rope grooves, and the counterweight 2 is supported by a grooved diverting pulley 9. The diverting pulleys 4 and 5 preferably rotate substantially in the same plane. The hoisting ropes 3 usually consist of several ropes placed side by side, usually at least three ropes. The drive machine unit 6 of the elevator with a traction sheave 7 acting on the hoisting ropes 3 is placed at the top part of the elevator shaft.

The elevator car 1 and the counterweight 2 travel in the elevator shaft along elevator and counterweight guide rails 10,11 which guide them and are placed in the shaft on the same side relative to the elevator car. The elevator car is suspended on the guide rails in a manner called rucksack suspension, which means that the elevator car 1 and its supporting structures are almost entirely on one side of the plane between the elevator guide rails 10. The elevator and counterweight guide rails 10,11 are implemented as an integrated rail unit 12 having guide surfaces for guiding the elevator car 1 and the counterweight 2. Such a rail unit can be installed faster than separate guide tracks. The elevator and counterweight guides are not shown in the figure.

In FIG. 3, the hoisting ropes 3 run as follows: One end of the hoisting ropes is fixed to an anchorage 13 above the path of the counterweight 2 at the top part of the shaft of the counterweight 2. From the anchorage 13, the ropes go downwards until they meet a diverting pulley 9 rotatably mounted on the counterweight 2. Having passed around the diverting pulley 9, the ropes 3 go again upwards to the traction sheave 7 of the drive machine 6, passing over it along rope grooves. From the traction sheave 7 the ropes go downwards to the elevator car 1, passing under it via the diverting pulleys 4,5 supporting the elevator car 1 on the ropes and continuing upwards to an anchorage 14 at the top part of the shaft, where the other end of the ropes is fixed. The positions of the rope anchorage point 13 in the top part of the shaft, the traction sheave 7 and the diverting pulley 9 supporting the counterweight on the ropes are preferably so aligned relative to each other that the rope section between the anchorage point 13 and the counterweight 2 as well as the rope section between the counterweight 2 and the traction sheave 7 run substantially in the direction of the path of the counterweight 2. Another advantageous solution is one in which the anchorage 14 in the top part of the shaft, the traction sheave 7 and the diverting pulleys 4,5 supporting the elevator car are so positioned relative to each other that the rope section going from anchorage 14 to the elevator car 1 and the rope section going from the elevator car 1 to the traction sheave 7 both run in a direction essentially parallel to the path of the elevator car 1. In this case no extra diverting pulleys are needed to direct the passage of the ropes in the shaft. The effect of the rope suspension on the elevator car 1 is substantially centric if the rope pulleys 4,5 are placed essentially symmetrically with respect to the vertical midline of the elevator car 1. A suspension arrangement where the ropes go diagonally under the floor of the car provides an advantage regarding elevator lay-out because the vertical portions of the ropes are close to the corners of the car and are therefore not an obstacle e.g. to placing the door on one of the sides of the car 1.

The machine unit 6 placed above the path of the counterweight 2 is of a flat construction as compared to the width of the counterweight, its thickness being preferably at most equal to that of the counterweight. The machine unit 6 includes the equipment that may be needed for the supply of power to the motor driving the traction sheave 7 as well as the necessary elevator control equipment, both of said equipments 8 being adjoined to the machine unit 6, possibly integrated with it. All essential parts of the machine unit 6 with the associated equipments 8 are within the shaft space extension needed above the shaft space for the counterweight 2, including the safety distance. Outside of this extension may only go some parts inessential to the invention, such as the lugs (not shown in the figures) needed to fix the machinery to the ceiling of the elevator shaft or other structure in the top part of the shaft, or the brake handle. Elevator regulations typically require a 25-mm safety distance from a movable component, but even larger safety distances may be applied because of certain country-specific elevator regulations or for other reasons.

Figure 4B:
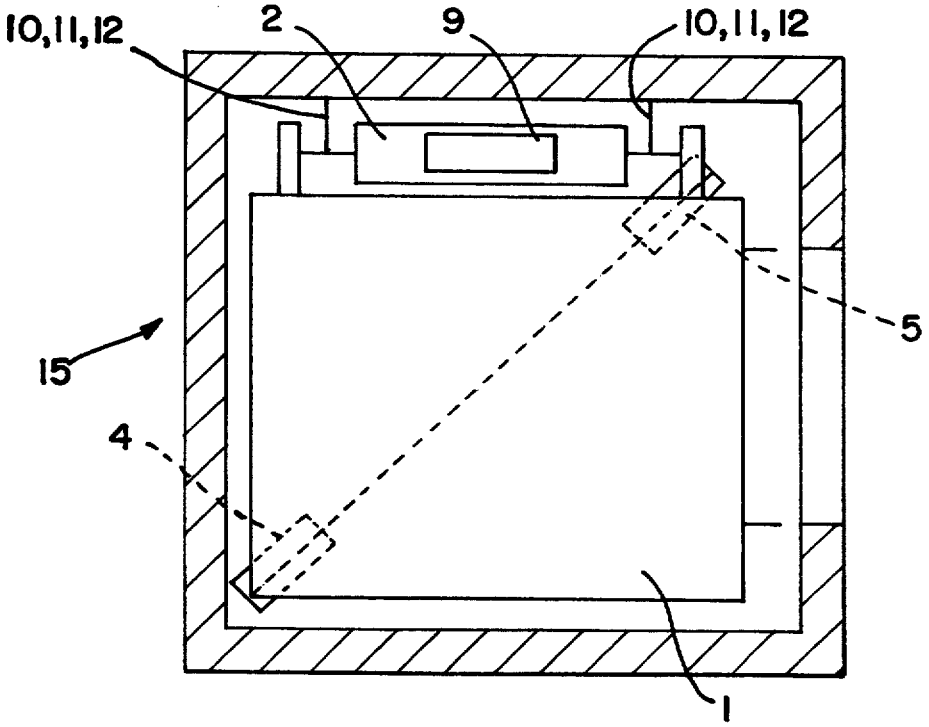
FIG. 4*b* shows the elevator of FIG. 4*a* in top view.
Figure 4A:
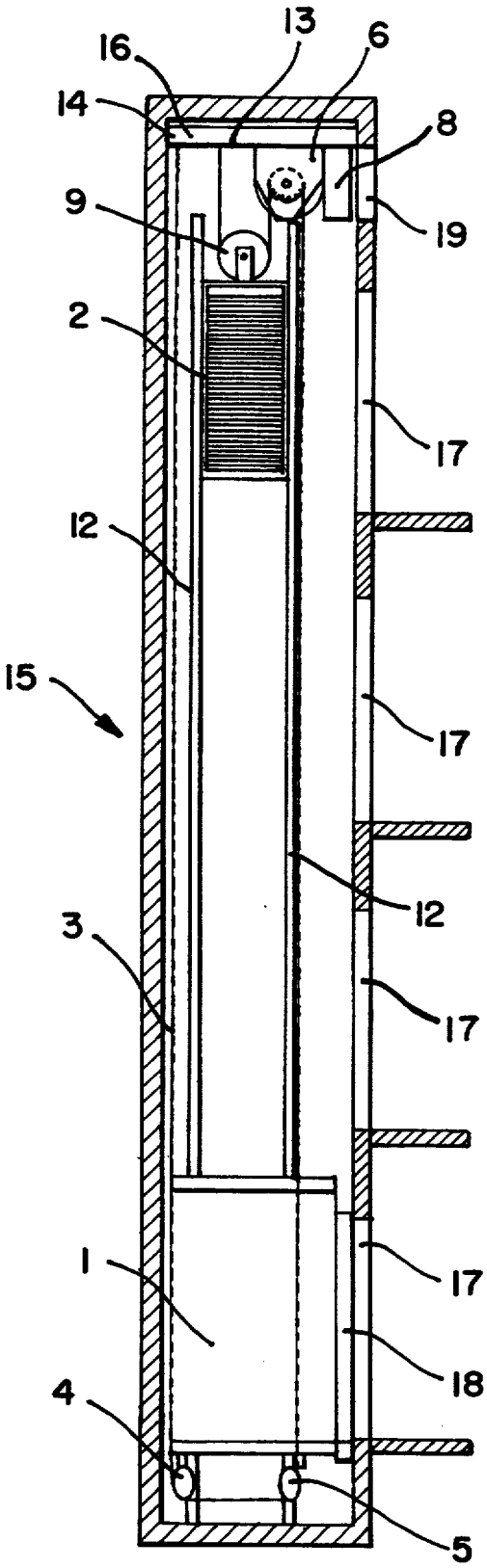
FIG. 4*a* presents a diagram illustrating the placement of an elevator according to the invention in an elevator shaft in lateral view.
Figure 4C:
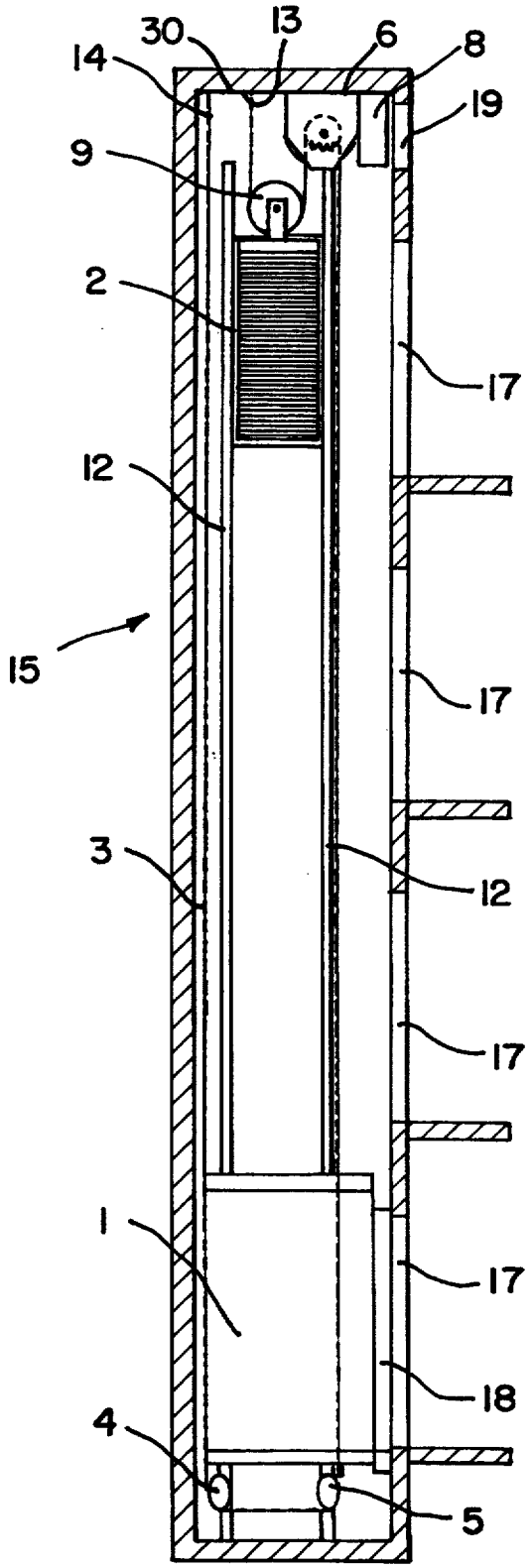
FIG. 4*c* shows the elevator of FIG. 4*a* with the drive machine unit fixed to the ceiling of the elevator shaft.

FIG. 4*a* presents a diagram illustrating the placement of an elevator according to the invention in an elevator shaft 15 as seen from one side. The elevator car 1 and counterweight 2 are suspended in the manner presented in FIG. 3 on the guide rail units 12 and the hoisting ropes 3 (indicated here with a broken line). Near the top of the elevator shaft 15 is a mounting beam 16, to which is fixed a control panel 8 containing the equipment required for power supply to the motor and for elevator control. The mounting beam 16 can be fabricated by fixing the machine unit 6 and the control panel 8 to it at the factory, or the mounting beam can be implemented as part of the frame structure of the machinery, thus forming a 'lug' for fixing the machine unit 6 to the wall or ceiling of the shaft 15. The beam 16 is also provided with an anchorage 13 for at least one end of the hoisting ropes 3. The other end of the hoisting ropes is often fixed to an anchorage 14 located somewhere else except on the mounting beam 16. The elevator shaft 15 is provided with a landing door 17 for each floor, and the elevator car 1 has a car door 18 on the side facing the landing doors. On the topmost floor there is a service hatch 19 opening into the shaft space and so placed that a serviceman can reach the control panel 8 and the machinery 6 through the hatch, if not from the floor then at least from a working platform placed at some height above the floor. The service hatch 19 is so placed and dimensioned that the emergency operation stipulated by elevator regulations can be performed with sufficient ease via the hatch. Ordinary service operations on the machinery 6 and control panel 8 can be performed while standing on the top of the elevator car 1. FIG. 4*b* presents the elevator of FIG. 3 in top view, showing how the guide rail units 12, counterweight 2 and elevator car 1 are placed in the cross-section of the elevator shaft 15. The figure also shows the diverting pulleys 4,5,9 used to suspend the elevator car 1 and counterweight 2 on the hoisting ropes 3. In FIG. 4*b*, the guide rail lines 10,11 for the elevator car and counterweight are essentially in the same plane between the elevator car and the counterweight with the rail ridges placed in the direction of this plane. FIG. 4*c* is similar to FIG. 4*a*, except it shows the machine unit 6 mounted to the ceiling 30 of the elevator shaft.

A preferable drive machinery consists of a gearless machine with an electromotor whose rotor and stator are so mounted that one is immovable with respect to the traction sheave 7 and the other with respect to the frame of the drive machine unit 6. Often the essential parts of the motor are preferably inside the rim of the traction sheave. The action of the operating brake of the elevator is applied to the traction sheave. In this case the operating brake is preferably integrated with the motor. In practical applications, the solution of the invention regarding the machinery means a maximum thickness of 20 cm for small elevators and 30–40 cm or more for large elevators with a high hoisting capacity.

The hoisting machine unit 6 employed in the invention, together with the motor, can be of a very flat construction. For example, in an elevator with a load capacity of 800 kg, the rotor of the motor of the invention has a diameter of 800 mm and the minimum thickness of the whole hoisting machine unit is only about 160 mm. Thus, the hoisting machine unit used in the invention can be easily accommodated in the space according to the extension of the counterweight path. The large diameter of the motor involves the advantage that a gear system is not necessarily needed.

Figure 5:
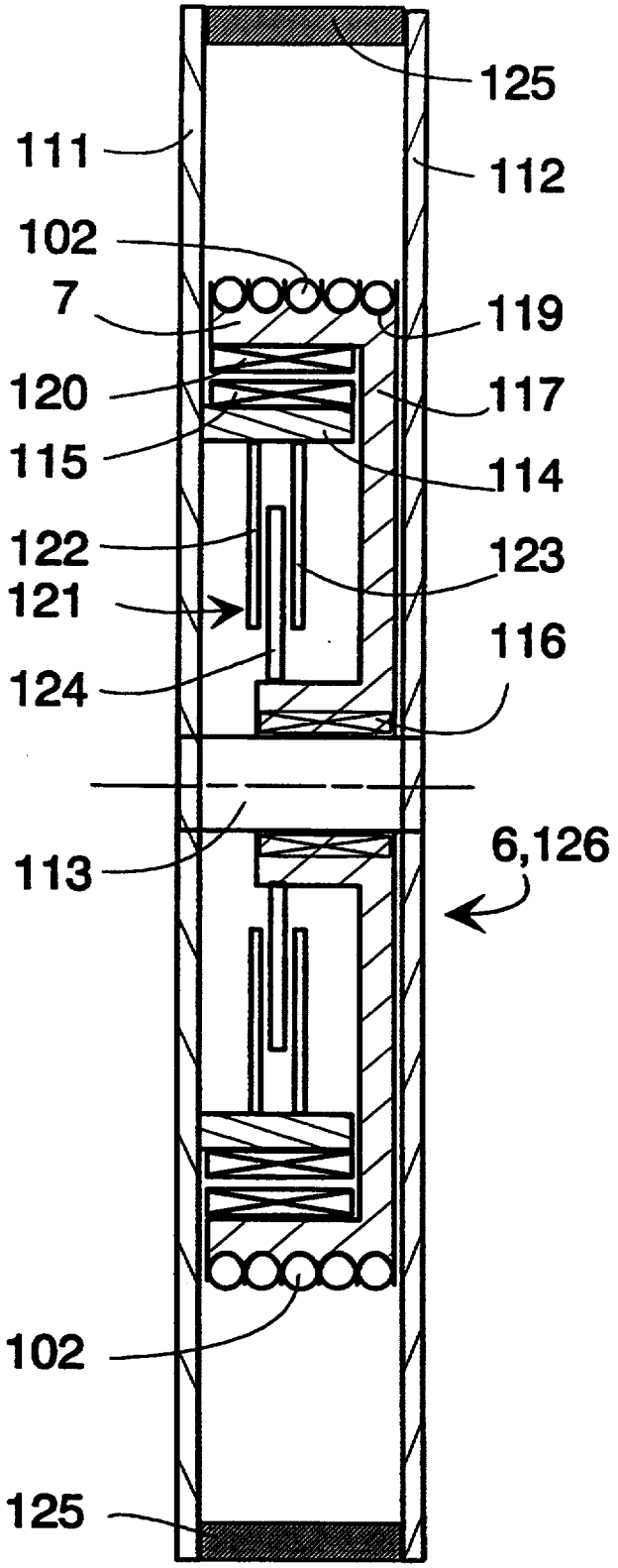
FIG. 5 presents a cross-section of a hoisting machine unit applied in the invention.

FIG. 5 presents a cross-section of the hoisting machine unit 6, showing the elevator motor 126 in top view. The motor 126 is implemented as a structure suitable for a drive machine unit 6 by making the motor 126 from parts usually called endshields and an element 111 supporting the stator and at the same time forming a side plate of the hoisting machine unit. The side plate 111 thus constitutes a frame part transmitting the load of the motor and at the same time the load of the hoisting machine unit. The unit has two supporting elements or side plates, 111 and 112, which are connected by an axle 113. Attached to side plate 111 is the stator with a stator winding 115 on it. Alternatively, side plate 111 and the stator can be integrated into a single structure. The rotor 117 is mounted on the axle 113 by means of a bearing 116. The traction sheave 7 on the outer surface of the rotor 117 is provided with five rope grooves 119. Each one of the five ropes 102 goes about once around the traction sheave. The traction sheave 7 may be a separate cylindrical body placed around the rotor 117, or the rope grooves of the traction sheave 7 may be made directly on the outer surface of the rotor as shown in FIG. 5. The rotor winding 120 is placed on the inner surface of the rotor. Between the stator 114 and the rotor 117 is a brake 121 consisting of brake plates 122 and 123 attached to the stator and a brake disc 124 rotating with the rotor. The axle 113 is fixed to the stator, but alternatively it could be fixed to the rotor, in which case the bearing would be between the rotor 117 and side plate 111 or both side plates 111 and 112. Side plate 112 acts as an additional reinforcement and stiffener for the motor/hoisting machine unit. The horizontal axle 113 is fixed to opposite points on the two side plates 111 and 112. Together with connecting pieces 125, the side plates form a boxlike structure.

Figure 6:
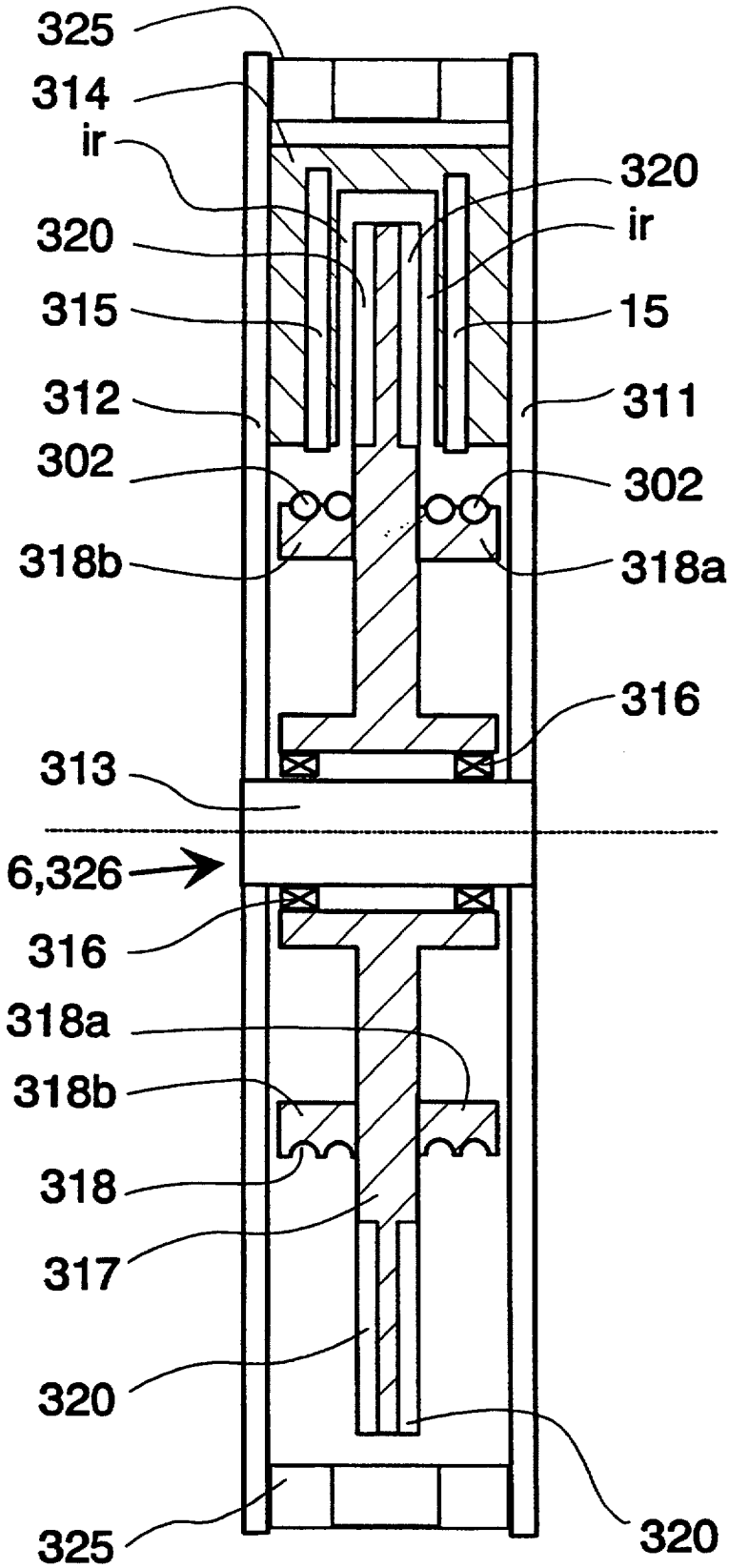
FIG. 6 presents a cross-section of another hoisting machine unit applied in the invention.

FIG. 6 presents a cross-section of another hoisting machine unit 6 applied in the invention. The machine unit 6 and the motor 326 are shown in side view. The machine unit 6 and motor 326 form an integrated structure. The motor 326 is substantially placed inside the machine unit 6. The stator 314 and the axle 313 of the motor are attached to the side plates 311 and 312 of the machine unit. Thus the side plates 311 and 312 of the machine unit also form the endshields of the motor, at the same time acting as frame parts transmitting the load of the motor and machine unit.

Fixed between the side plates 311 and 312 are sustainers 325 which also act as additional stiffeners of the machine unit.

The rotor 317 is rotatably mounted on the axle 313 with a bearing 316. The rotor is of a disc-shaped design and is placed in the axial direction essentially at the middle of the axle 313. Placed on either side of the rotor, between the windings and the axle, are two circular halves **318*a* and 318*b* of the traction sheave 318, both having the same diameter. Each half of the traction sheave carries the same number of ropes 302**.

The diameter of the traction sheave is smaller than that of the stator or rotor. The traction sheave being attached to the rotor, it is possible to use traction sheaves of different diameters with the same rotor diameter. Such variation provides the same advantage as the use of a gear system, and this is another advantage achieved by applying this kind of a motor in the invention. The traction sheave is fixed to the rotor disc in a manner known in itself, e.g. by means of screws. Of course, the two halves of the traction sheave 318 can alternatively be integrated with the rotor to form a single body.

Each one of the four ropes 302 runs over the traction sheave along its own groove. For the sake of clarity, the ropes are only shown as sections on the traction sheave.

The stator 314 together with the stator winding 315 forms a U-shaped sector or segmented sector resembling a clutching hand over the outer edge of the rotor, with the open side of the U-shape towards the ropes. The largest sector width possible in the structure depends on the relation of the inner diameter of the stator 314 and the diameter of the traction sheave 318. In practical solutions, an advantageous relationship of the magnitudes of these diameters is such that a sector diameter of 240 degrees is not exceeded. However, if the hoisting ropes 302 are brought closer to the vertical line passing through the axle 313 of the machine by providing the machine with diverting pulleys, the arrangement will easily allow the use of a sector of 240–300 degrees, depending on the position of the diverting pulleys below the motor. At the same time, the angle of contact of the ropes on the traction sheave is increased, improving the frictional grip of the traction sheave. Between the stator 314 and the rotor 317 are two air gaps in substantially perpendicular to the axle 313 of the motor.

If necessary, the hoisting machine unit can also be provided with a brake, which is placed e.g. inside the traction sheave between the side plates 311,312 and the rotor 317.

It is obvious to a person skilled in the art that different embodiments of the invention are not restricted to the examples described above, but that they may instead be varied within the scope of the claims presented below. For example, the number of times the hoisting ropes are passed between the top part of the elevator shaft and the counterweight or elevator car is not very decisive with regard to the basic advantages of the invention, although it is possible to achieve some additional advantages by using multiple rope stretches. In general, applications should be so designed that the ropes go to the elevator car at most as many times as to the counterweight. It is also obvious that the hoisting ropes need not necessarily be passed under the car.

In suspension arrangements where the path of the counterweight is shorter than that of the car, a somewhat shorter shaft length requirement is achieved by placing the machinery above the path of the counterweight than in suspension arrangements where the paths of the car and counterweight have equal lengths. It is also obvious that the hoisting ropes need not necessarily be passed under the car.

Furthermore, it is obvious to the skilled person that the larger machine size needed for elevators designed for heavy loads can be achieved by increasing the diameter of the electromotor, without substantially increasing the thickness of the machinery.

It is also obvious to the skilled person that the elevator car, counterweight and machine unit can be laid out in the cross-section of the elevator shaft in a way differing from the above examples. A possible different layout is one in which the machinery and counterweight are behind the car as seen from the shaft door and the ropes are passed under the car diagonally with respect to the bottom of the car. Passing the ropes diagonally or otherwise obliquely with respect to the shape of the car bottom is an advantageous solution which can be used in other types of suspension lay-outs as well to ensure that the car is symmetrically suspended on the ropes with respect to the center of mass of the elevator.

Furthermore, it is obvious to the skilled person that the equipment required for the supply of power to the motor and the equipment needed for the control of the elevator can be placed elsewhere except in conjunction with the machine unit, e.g. in a separate control panel. Similarly, it is obvious that an elevator implemented according to the invention can be equipped in a way differing from the examples presented. For instance, instead of an automatic door solution, the elevator could be equipped with a turn door.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

We claim:

1. A traction sheave elevator comprising:

an elevator car having an overhead extension, said elevator car being movable along elevator guide rails within a predetermined shaft space in an elevator shaft, the elevator shaft having at least one wall;

a counterweight movable along counterweight guide rails;

a set of hoisting ropes, the elevator car and the counterweight being suspended on the hoisting ropes;

a drive machine unit comprising a traction sheave driven by a drive machine and engaging the hoisting ropes, the drive machine unit being placed in a top part of the elevator shaft in a space between the at least one wall of the elevator shaft and the predetermined shaft space needed by the elevator car and the overhead extension.

2. The traction sheave elevator according to claim 1, wherein when the elevator car is at a highest extremity of its travel path, a top part of the elevator car reaches at least a level of a bottom edge of the drive machine unit.

3. The traction sheave elevator according to claim 1, wherein the drive machine unit and the counterweight are placed on a same side of the predetermined shaft space.

4. The traction sheave elevator according to claim 1, wherein the drive machine unit is placed above a path of the counterweight and wherein the drive machine unit is placed substantially inside an overhead shaft space extension needed for the counterweight in a thicknesswise direction of the counterweight, the overhead shaft space extension needed for the counterweight including a safety distance.

5. The traction sheave elevator according to claim 4, wherein the drive machine unit is completely inside the shaft space extension needed for the counterweight and wherein the elevator further comprises a control panel adjoined to the drive machine unit, the control panel supplying power to a motor for driving the traction sheave.

6. The traction sheave elevator according to claim 5, wherein the control panel is integrated with the drive machine unit.

7. The traction sheave elevator according to claim 1, wherein the drive machine unit is gearless and has a thickness not exceeding that of the counterweight.

8. The traction sheave elevator according to claim 1, wherein the traction sheave is rotatable in a plane, the plane of rotation of the traction sheave being substantially parallel to a plane between the counterweight guide rails.

9. The traction sheave elevator according to claim 1, wherein the drive machine unit is fixed in the elevator shaft to the at least one wall of the elevator shaft.

10. The traction sheave elevator according to claim 1, wherein the drive machine unit is fixed in the elevator shaft to a ceiling of the shaft.

11. The traction sheave elevator according to claim 1, further comprising a diverting pulley placed on the counterweight, the counterweight being suspended on the hoisting ropes by the diverting pulley.

12. The traction sheave elevator according to claim 1, further comprising diverting pulleys, both the counterweight and the elevator car being suspended on the hoisting ropes by the diverting pulleys.

13. The traction sheave elevator according to claim 1, wherein the counterweight moves along a counterweight path and wherein the elevator car moves along an elevator car path, the elevator car and counterweight being suspended on the hoisting ropes such that the counterweight path is shorter than the elevator car path.

14. The traction sheave elevator according to claim 1, wherein the hoisting ropes are passed under the elevator car and over two diverting pulleys.

15. The traction sheave elevator according to claim 14, wherein the hoisting ropes pass under a floor of the elevator car via a point directly below a center of mass of the elevator car.

16. The traction sheave elevator according to claim 14, wherein the hoisting ropes pass diagonally under a floor of the elevator car.

17. The traction sheave elevator according to claim 1, wherein the counterweight moves along a counterweight path and the elevator car moves along an elevator car path, and wherein those portions of the hoisting ropes from which the elevator car and the counterweight are suspended run substantially in a direction of the elevator car path and the counterweight path.

18. The traction sheave elevator according to claim 1, wherein the elevator car is suspended using rucksack-type suspension and wherein the guide rails for the elevator car and counterweight are on a same side of the car.

19. The traction sheave elevator according to claim 18, wherein the counterweight guide rails and the elevator guide rails are integrated into a guide rail unit provided with guide surfaces for both the counterweight and the car.

* * * * *